US011755045B1

(12) United States Patent
Hyun et al.

(10) Patent No.: US 11,755,045 B1
(45) Date of Patent: Sep. 12, 2023

(54) INTERNAL VOLTAGE GENERATION CIRCUIT

(71) Applicant: SK hynix Inc., Icheon-si (KR)

(72) Inventors: Jin Hoon Hyun, Icheon-si (KR); Chang Hyun Lee, Icheon-si (KR)

(73) Assignee: SK hynix Inc., Icheon-si (KR)

( * ) Notice: Subject to any disclaimer, the term of this patent is extended or adjusted under 35 U.S.C. 154(b) by 0 days.

(21) Appl. No.: 17/882,256

(22) Filed: Aug. 5, 2022

(30) Foreign Application Priority Data

Apr. 13, 2022 (KR) ..... 10-2022-0045953

(51) Int. Cl.
*G05F 1/46* (2006.01)
*G05F 1/595* (2006.01)

(52) U.S. Cl.
CPC ..... *G05F 1/465* (2013.01); *G05F 1/595* (2013.01)

(58) Field of Classification Search
None
See application file for complete search history.

(56) References Cited

U.S. PATENT DOCUMENTS 10,873,257 B2 * 12/2020 Harjani ..... G05F 1/575
2015/0097541 A1 * 4/2015 Banag ..... G05F 1/575 323/281
2017/0365325 A1 12/2017 Murakami

FOREIGN PATENT DOCUMENTS

KR 100184449 B1 4/1999
KR 101659901 B1 9/2016

* cited by examiner

*Primary Examiner* — Thomas J. Hiltunen
(74) *Attorney, Agent, or Firm* — WILLIAM PARK & ASSOCIATES LTD.

(57) ABSTRACT

An internal voltage generation circuit includes a shifting source voltage generation circuit configured to generate a shifting source voltage having a voltage level that falls as a voltage level of a power supply voltage rises during a period when the power supply voltage is lower than a preset voltage level. The internal voltage generation circuit also includes an internal voltage regulator configured to generate a driving signal through a level shifting operation that is performed according to the shifting source voltage received when driving an internal voltage and configured to drive the internal voltage based on the driving signal.

19 Claims, 10 Drawing Sheets

FIG.6

$$I1 = I2 \quad \cdots\cdots \text{S211}$$

$$\frac{VDD-V(+)}{R1} = \frac{V(+)-VREF_DET}{R2} \quad \cdots\cdots \text{S213}$$

IF R1 = R2
VREF_DET = -VDD + 2V(+) ····· S215

INTERNAL VOLTAGE GENERATION CIRCUIT

CROSS-REFERENCES TO RELATED APPLICATIONS

The present application claims priority under 35 U.S.C. § 119(a) to Korean application number 10-2022-0045953, filed in the Korean Intellectual Property Office on Apr. 13, 2022, the entire disclosure of which is incorporated herein by reference.

BACKGROUND

The present disclosure relates to an internal voltage generation circuit having drivability that is adjusted based on a power supply voltage.

Typically, an electronic device receives an external power supply voltage VDD and a ground voltage VSS, and generates and uses various internal voltages required for internal operations. The electronic device may generate an internal voltage that is driven to a lower level than the power supply voltage VDD, by using a voltage generator, or generate an internal voltage that is driven to a higher level than the power supply voltage VDD, by using a pumping circuit.

SUMMARY

In accordance with an embodiment of the present disclosure, an internal voltage generation circuit may include a shifting source voltage generation circuit configured to generate a shifting source voltage having a voltage level that falls as the voltage level of a power supply voltage rises during a period when the power supply voltage is lower than a preset voltage level. The internal voltage generation circuit may also include an internal voltage regulator configured to generate a driving signal through a level shifting operation that is performed according to the shifting source voltage received when driving an internal voltage and configured to drive the internal voltage based on the driving signal.

In accordance with another embodiment of the present disclosure, an internal voltage generation circuit may include a first detection reference voltage generation circuit configured to generate a detection reference voltage having a voltage level that falls as a voltage level of a power supply voltage rises during a period when the power supply voltage is lower than a preset voltage level. The internal voltage generation circuit may also include a shifting source voltage regulator configured to generate the shifting source voltage based on the detection reference voltage and the shifting source voltage. The internal voltage generation circuit may further include an internal voltage regulator configured to generate a driving signal through a level shifting operation that is performed according to the shifting source voltage received when driving an internal voltage and configured to drive the internal voltage based on the driving signal.

BRIEF DESCRIPTION OF THE DRAWINGS

FIGS. 5 to 7 are diagrams for describing an operation of the detection reference voltage generation circuit in accordance with the embodiment.

DETAILED DESCRIPTION

In the descriptions of the following embodiments, the term "preset" indicates that the value of a parameter is previously decided, when the parameter is used in a process or algorithm. According to different embodiments, the value of the parameter may be set before the process or algorithm is started, when the process or algorithm is started, or while the process or algorithm is being performed.

Terms such as "first" and "second," which are used to distinguish among various components, are not limited by the components. For example, a first component may be referred to as a second component, and vice versa. Terms such as "first" and "second" are not used to indicate a number or order of components.

When one component is referred to as being "coupled" or "connected" to another component, it should be understood that the components may be directly coupled or connected to each other or coupled or connected to each other through another component interposed therebetween. On the other hand, when one component is referred to as being "directly coupled" or "directly connected" to another component, it should be understood that the components are directly coupled or connected to each other without another component interposed therebetween.

"Logic high level" and "logic low level" are used to describe the logic levels of signals. A signal having a "logic high level" is distinguished from a signal having a "logic low level." For example, when a signal having a first voltage corresponds to a "logic high level," a signal having a second voltage may correspond to a "logic low level." According to an embodiment, a "logic high level" may be set to a voltage higher than a "logic low level." According to an embodiment, the logic levels of signals may be set to different logic levels or opposite logic levels. For example, a signal having a logic high level may be set to have a logic low level according to an embodiment, and a signal having a logic low level may be set to have a logic high level according to an embodiment.

Hereafter, teachings of the present disclosure will be described in more detail through embodiments. The embodiments are only used to exemplify the teachings of the present disclosure, and the scope of the present disclosure is not limited by the embodiments.

Figure 1:
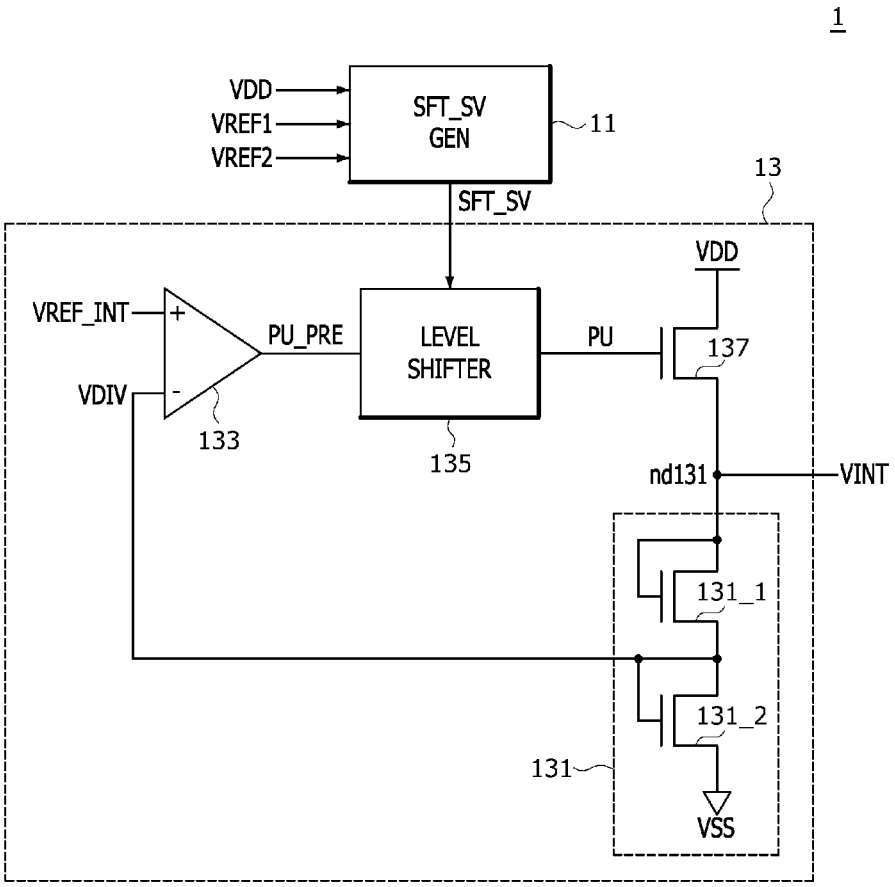
FIG. 1 is a diagram illustrating the configuration of an internal voltage generation circuit in accordance with an embodiment.

FIG. 1 is a diagram illustrating a configuration of an internal voltage generation circuit 1 in accordance with an embodiment. As illustrated in FIG. 1, the internal voltage generation circuit 1 may include a shifting source voltage generation circuit (SFT_SV GEN) 11 and an internal voltage regulator 13.

The shifting source voltage generation circuit 11 may generate a shifting source voltage SFT_SV based on a power supply voltage VDD, a first reference voltage VREF1, and a second reference voltage VREF2. The shifting source voltage generation circuit 11 may generate the shifting source voltage SFT_SV having a voltage level that falls as the voltage level of the power supply voltage VDD rises during a period when the power supply voltage VDD is lower than a preset voltage level. The shifting source voltage generation circuit 11 may generate the shifting source voltage SFT_SV having a constant voltage level during a period when the power supply voltage VDD is equal to or higher than the preset voltage level.

The internal voltage regulator 13 may be coupled to the shifting source voltage generation circuit 11, and receive the shifting source voltage SFT_SV from the shifting source voltage generation circuit 11. The internal voltage regulator 13 may generate a driving signal PU through a level shifting operation that is performed according to the shifting source voltage SFT_SV received when it is necessary to drive an internal voltage VINT, and may drive the internal voltage VINT based on the driving signal PU. The internal voltage regulator 13 may include a voltage divider 131, an internal voltage comparator 133, a level shifter 135, and an internal voltage driving element 137.

The voltage divider 131 may include NMOS transistors 131_1 and 131_2 coupled in series between a supply terminal of the ground voltage VSS and a node nd131 from which the internal voltage VINT is output. The NMOS transistors 131_1 and 131_2 may be each implemented as a resistor. The voltage divider 131 may generate a divided voltage VDIV by dividing the internal voltage VINT according to the ratio of resistance values of the NMOS transistors 131_1 and 131_2. For example, when the resistance values of the NMOS transistors 131_1 and 131_2 are set to the same value, the voltage divider 131 may generate the divided voltage VDIV having a voltage level corresponding to ½ of the voltage level of the internal voltage VINT.

The internal voltage comparator 133 may be coupled to the voltage divider 131 and the level shifter 135. The internal voltage comparator 133 may receive the divided voltage VDIV from the voltage divider 131. The internal voltage comparator 133 may generate a pre-driving signal PU_PRE by comparing the divided voltage VDIV to an internal reference voltage VREF_INT. For example, the voltage level of the internal reference voltage VREF_INT may be set to a voltage level corresponding to ½ of the voltage level of the internal voltage VINT. However, this is only an embodiment, and the internal reference voltage VREF_INT is not limited thereto. The internal voltage comparator 133 may generate the pre-driving signal PU_PRE that is activated when the divided voltage VDIV has a voltage level lower than the internal reference voltage VREF_INT, and may generate the pre-driving signal PU_PRE that is deactivated when the divided voltage VDIV has a voltage level equal to or higher than the internal reference voltage VREF_INT. The internal voltage comparator 133 may apply the pre-driving signal PU_PRE to the level shifter 135.

The level shifter 135 may be coupled to the internal voltage comparator 133, the shifting source voltage generation circuit 11, and the internal voltage driving element 137. The level shifter 135 may receive the pre-driving signal PU_PRE from the internal voltage comparator 133, and receive the shifting source voltage SFT_SV from the shifting source voltage generation circuit 11. The level shifter 135 may generate the driving signal PU based on the pre-driving signal PU_PRE and the shifting source voltage SFT_SV. The level shifter 135 may generate the driving signal PU that is shifted to the shifting source voltage SFT_SV and activated when the pre-driving signal PU_PRE is activated. The level shifter 135 may generate the driving signal PU that is deactivated when the pre-driving signal PU_PRE is deactivated. The level shifter 135 may apply the driving signal PU to the internal voltage driving element 137.

The internal voltage driving element 137 may be coupled to the level shifter 135 and the node nd131. The internal voltage driving element 137 may receive the driving signal PU from the level shifter 135. The internal voltage driving element 137 may be implemented as an NMOS transistor which is turned on to drive the internal voltage VINT to the power supply voltage VDD, when the driving signal PU is activated to the shifting source voltage SFT_SV. The internal voltage driving element 137 may drive the internal voltage VINT with sufficient drivability through the NMOS transistor that is turned on by the shifting source voltage SFT_SV having a high voltage level during a period when the voltage level of the power supply voltage VDD is set to a low level.

The internal voltage generation circuit 1 may generate the shifting source voltage SFT_SV set to a voltage level that falls as the voltage level of the power supply voltage VDD rises during a period when the voltage level of the power supply voltage VDD is lower than a preset voltage level, and may supply the shifting source voltage SFT_SV to the level shifter 135 that generates the driving signal PU, such that the drivability to drive the internal voltage VINT decreases with the rise in level of the power supply voltage. Furthermore, the internal voltage generation circuit 1 may generate the shifting source voltage SFT_SV set to a constant voltage level during a period when the voltage level of the power supply voltage VDD is equal to or higher than the preset voltage level, and may supply the shifting source voltage SFT_SV to the level shifter 135 that generates the driving signal PU, thereby securing drivability suitable for driving the internal voltage VINT.

Figure 2:
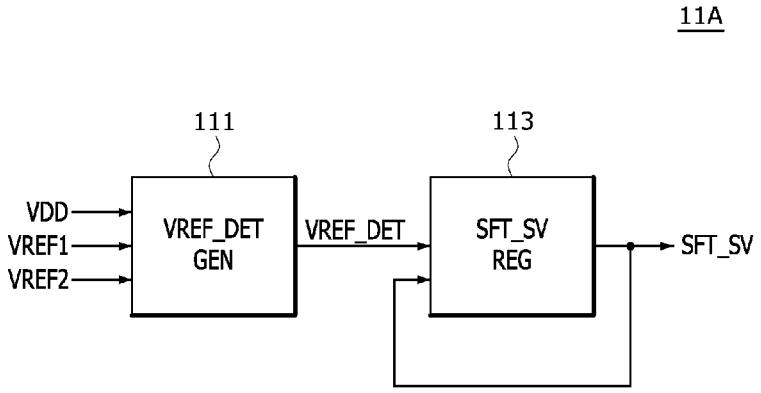
FIG. 2 is a circuit diagram illustrating a shifting source voltage generation circuit in accordance with an embodiment.

FIG. 2 is a circuit diagram illustrating a shifting source voltage generation circuit 11A in accordance with an embodiment. For an embodiment, the shifting source voltage generation circuit 11A represents the shifting source voltage generation circuit 11 of FIG. 1. As illustrated in FIG. 2, the shifting source voltage generation circuit 11A may include a detection reference voltage generation circuit (VREF_DET GEN) 111 and a shifting source voltage regulator (SFT_SV REG) 113.

The detection reference voltage generation circuit 111 may generate a detection reference voltage VREF_DET based on the power supply voltage VDD, the first reference voltage VREF1, and the second reference voltage VREF2. The detection reference voltage generation circuit 111 may perform a comparison operation based on the power supply voltage VDD and the first reference voltage VREF1, and thus generate the detection reference voltage VREF_DET having a voltage level that falls as the voltage level of the power supply voltage VDD rises during a period when the power supply voltage VDD is lower than a preset voltage level. For example, when a voltage level that is generated by dividing the power supply voltage VDD is lower than the first reference voltage VREF1, the detection reference voltage generation circuit 111 may generate the detection reference voltage VREF_DET having a voltage level that falls as the voltage level of the power supply voltage VDD rises. The detection reference voltage generation circuit 111 may perform a comparison operation based on the detection reference voltage VREF_DET and the second reference voltage VREF2, and thus generate the detection reference voltage VREF_DET having a constant voltage level during a period when the power supply voltage VDD is equal to or higher than the preset voltage level. For example, when the voltage level of the detection reference voltage VREF_DET that is generated according to the power supply voltage VDD having a rising voltage level is set to the same voltage level as the second reference voltage VREF2, the detection reference voltage generation circuit 111 may retain the detection reference voltage VREF_DET at the same voltage level as the second reference voltage VREF2, regardless of the voltage level of the power supply voltage VDD.

The shifting source voltage regulator 113 may be coupled to the detection reference voltage generation circuit 111, may receive the detection reference voltage VREF_DET from the detection reference voltage generation circuit 111, and may receive the shifting source voltage SFT_SV as feedback. The shifting source voltage regulator 113 may generate the shifting source voltage SFT_SV based on the detection reference voltage VREF_DET and the shifting source voltage SFT_SV. The shifting source voltage regulator 113 may generate the shifting source voltage SFT_SV according to a comparison operation between the detection reference voltage VREF_DET and the shifting source voltage SFT_SV. For example, when a voltage level that is generated by dividing the shifting source voltage SFT_SV is lower than the detection reference voltage VREF_DET, the shifting source voltage regulator 113 may pump or drive the voltage level of the shifting source voltage SFT_SV. The shifting source voltage regulator 113 may generate the shifting source voltage SFT_SV having a higher voltage level than the detection reference voltage VREF_DET. For example, the shifting source voltage regulator 113 may generate the shifting source voltage SFT_SV having a voltage level that is set to a higher voltage level than the detection reference voltage VREF_DET, by pumping the shifting source voltage SFT_SV based on the detection reference voltage VREF_DET. The voltage level of the shifting source voltage SFT_SV that is generated by the shifting source voltage regulator 113 may be set to a voltage level that falls as the voltage level of the power supply voltage VDD rises during a period when the voltage level of the power supply voltage VDD is lower than the preset voltage level. The voltage level of the shifting source voltage SFT_SV that is generated by the shifting source voltage regulator 113 may be set to a constant voltage level during a period when the voltage level of the power supply voltage VDD is equal to or higher than the preset voltage level.

Figure 3:
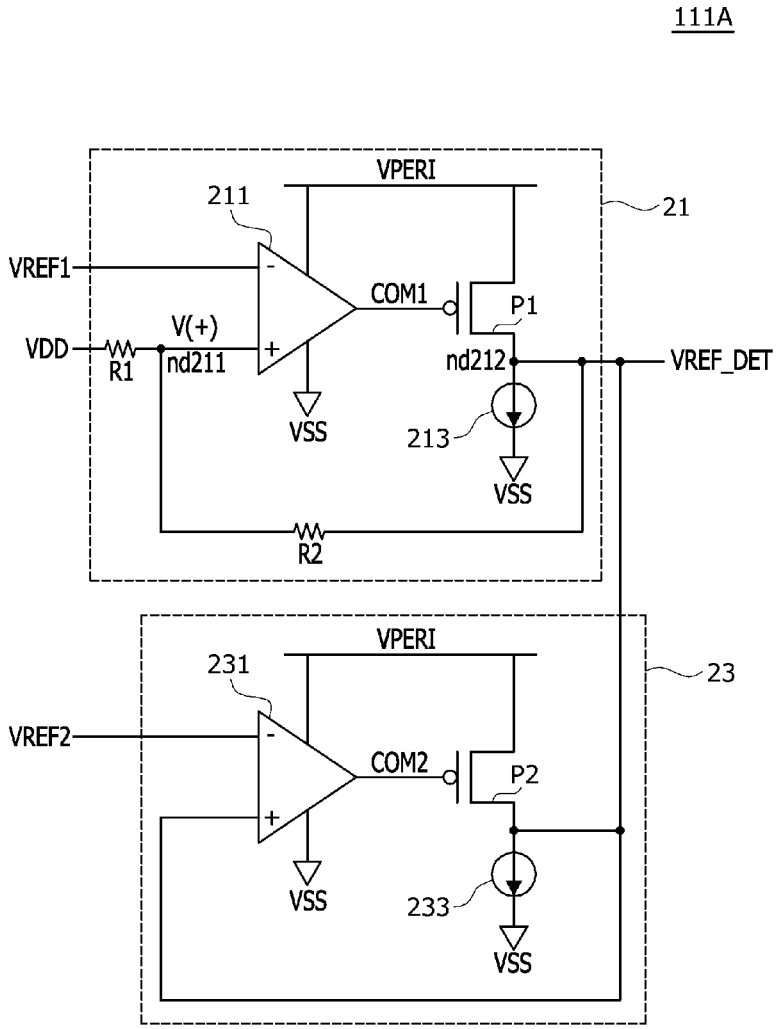
FIG. 3 is a circuit diagram illustrating a detection reference voltage generation circuit in accordance with an embodiment.

FIG. 3 is a circuit diagram illustrating a detection reference voltage generation circuit 111A in accordance with an embodiment. For an embodiment, the detection reference voltage generation circuit 111A represents the detection reference voltage generation circuit 111. As illustrated in FIG. 3, the detection reference voltage generation circuit 111A may include a first detection reference voltage generation circuit 21 and a second detection reference voltage generation circuit 23.

The first detection reference voltage generation circuit 21 may include resistors R1 and R2, a first comparator 211, a first driving element P1, and a first current source 213. The resistor R1 may be coupled between a supply terminal of the power supply voltage VDD and a node nd211, and the resistor R2 may be coupled between the node nd211 and a node nd212 from which the detection reference voltage VREF_DET is outputted. The first comparator 211 may receive a positive input voltage V(+) of the node nd211, which is generated by dividing the power supply voltage VDD based on the resistance values of the resistors R1 and R2, through a positive input terminal thereof, and may receive the first reference voltage VREF1 through a negative input terminal thereof. The first comparator 211 may generate a first comparison signal COM1 by comparing the positive input voltage V(+) and the first reference voltage VREF1. The first driving element P1 may be turned on based on the first comparison signal COM1, and may drive the detection reference voltage VREF_DET to an operation voltage VPERI. The first current source 213 may discharge the node nd212. The first detection reference voltage generation circuit 21 may turn on the first driving element P1 according to the first comparison signal COM1 that is activated to a logic low level during a period when the positive input voltage V(+) has a voltage level equal to or lower than the first reference voltage VREF1. The first detection reference voltage generation circuit 21 may generate the detection reference voltage VREF_DET having a voltage level that falls as the voltage level of the power supply voltage VDD rises, while the first driving element P1 is turned on.

The second detection reference voltage generation circuit 23 may include a second comparator 231, a second driving element P2, and a second current source 233. The second comparator 231 may receive the detection reference voltage VREF_DET through a positive input terminal thereof, and may receive the second reference voltage VREF2 through a negative input terminal thereof. The second comparator 231 may generate a second comparison signal COM2 by comparing the detection reference voltage VREF_DET and the second reference voltage VREF2. The second driving element P2 may be turned on based on the second comparison signal COM2, and may drive the node nd212, from which the detection reference voltage VREF_DET is outputted, to the operation voltage VPERI. The second current source 233 may discharge the node nd212. The second detection reference voltage generation circuit 23 may turn on the second driving element P2 according to the second comparison signal COM2 that is activated to a logic low level when the voltage level of the detection reference voltage VREF_DET that is generated according to the power supply voltage VDD having a rising voltage level is set to the same voltage level as the second reference voltage VREF2. The second detection reference voltage generation circuit 23 may generate the detection reference voltage VREF_DET that retains the same voltage level as the second reference voltage VREF2 regardless of the voltage level of the power supply voltage VDD, while the second driving element P2 is turned on.

Figure 4:
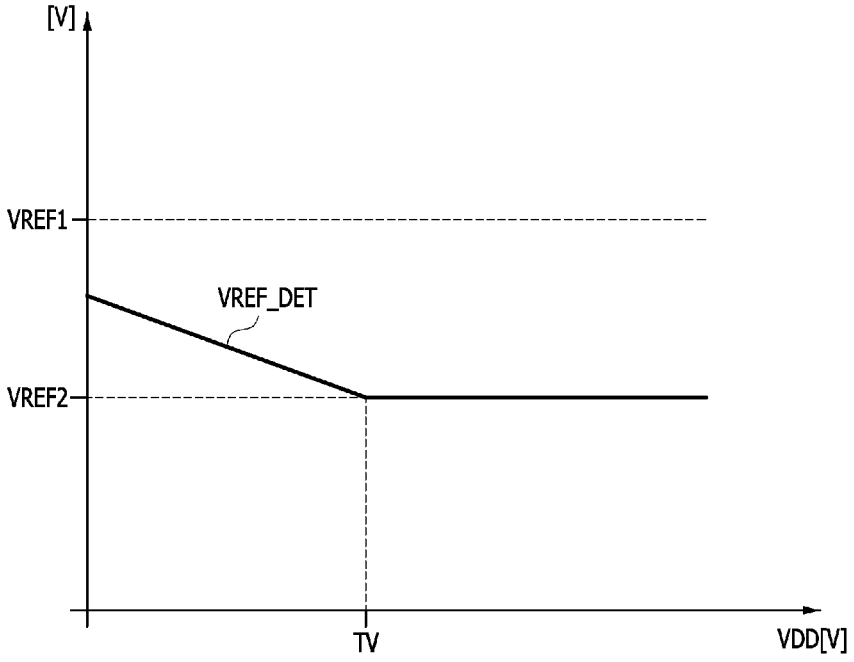
FIG. 4 is a graph illustrating the waveform of a detection reference voltage that is generated by the detection reference voltage generation circuit in accordance with the embodiment.

FIG. 4 is a graph illustrating the waveform of the detection reference voltage VREF_DET that is generated by the detection reference voltage generation circuit 111A. As illustrated in FIG. 4, the voltage level of the detection reference voltage VREF_DET may be set to a voltage level that falls as the voltage level of the power supply voltage VDD rises during a period when the power supply voltage VDD is lower than a preset voltage level TV, and may be set to the same voltage level as the second reference voltage VREF2 during a period when the power supply voltage VDD is equal to or higher than the preset voltage level TV.

Figure 5:
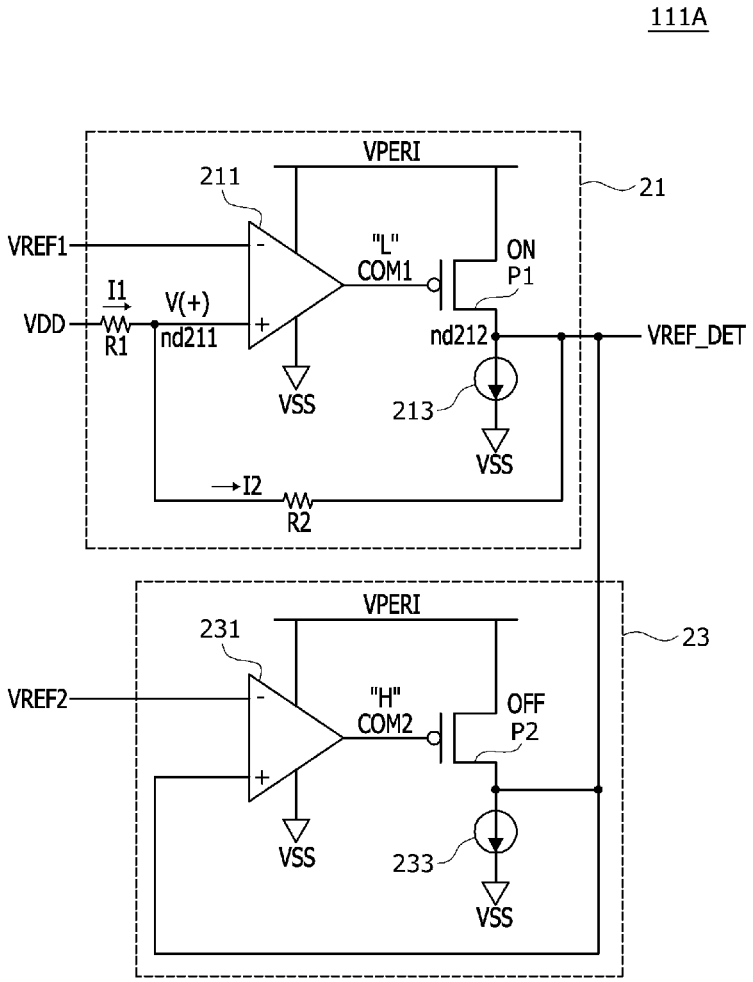
Figure 7:
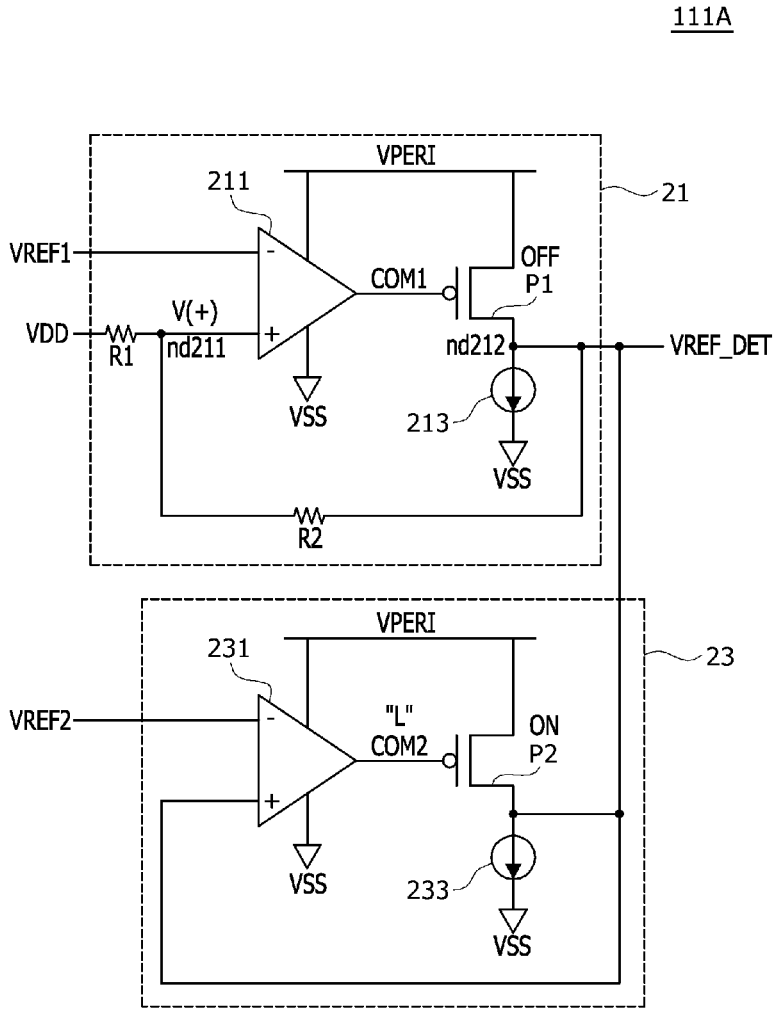

FIGS. 5 to 7 are diagrams for describing an operation of the detection reference voltage generation circuit 111A in accordance with an embodiment.

As illustrated in FIG. 5, the first comparison signal COM1 that is output from the first comparator 211 during a period when the positive input voltage V(+) has a voltage level equal to or lower than the first reference voltage VREF1 may be generated as a logic low level "L." Thus, the first driving element P1 may be turned "ON." At this time, the second comparison signal COM2 that is output from the second comparator 231 may be generated as a logic high level "H." Thus, the second driving element P2 may be turned "OFF." While the first driving element P1 is turned "ON," the voltage level of the detection reference voltage VREF_DET may be set to a voltage level that falls as the voltage level of the power supply voltage VDD rises. The relationship between the detection reference voltage VREF_DET and the power supply voltage VDD will be described as follows with reference to equations S211, S213, and S215 shown in FIG. 6.

First, as expressed in S211 of FIG. 6, a first current I1 that is input to the node nd211 and a second current I2 that is discharged from the node nd211 are set to the same value, according to Kirchhoff's current law. As expressed in S213 of FIG. 6, the first current I1 is set to a value that is obtained by dividing a value, obtained by subtracting the positive input voltage V(+) from the power supply voltage VDD, by the resistance value of the first resistor R1. The second current I2 is set to a value that is obtained by dividing a value, obtained by subtracting the detection reference voltage VREF_DET from the positive input voltage V(+), by the resistance value of the second resistor R2, according to Ohm's law. Finally, if the resistance value of the first resistor R1 and the resistance value of the second resistor R2 are set to the same value as expressed in S215 of FIG. 6, the detection reference voltage VREF_DET may be set to a value obtained by subtracting the voltage level of the power supply voltage VDD from the double of the voltage level of the positive input voltage V(+). Therefore, the voltage level of the detection reference voltage VREF_DET may be set in inverse proportion to the voltage level of the power supply voltage VDD. That is, the voltage level of the detection reference voltage VREF_DET may be set to a voltage level that falls as the voltage level of the power supply voltage VDD rises.

As illustrated in FIG. 7, when the voltage level of the detection reference voltage VREF_DET that is generated according to the power supply voltage VDD having a rising voltage level is set to the same voltage level as the second reference voltage VREF2, the second comparison signal COM2 that is output from the second comparator 231 may be generated as a logic low level "L." Thus, the second driving element P2 may be turned "ON." While the second driving element P2 is turned "ON," the detection reference voltage VREF_DET may retain the same voltage level as the second reference voltage VREF2 regardless of the voltage level of the power supply voltage VDD.

Figure 8:
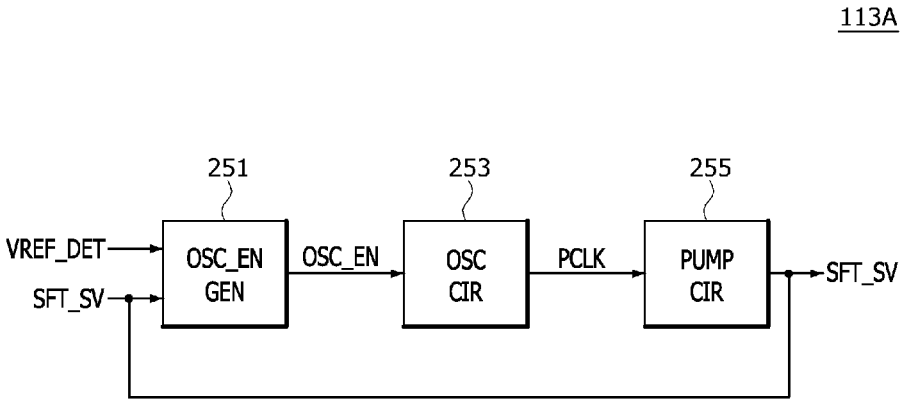
FIG. 8 is a block diagram illustrating the configuration of a shifting source voltage regulator in accordance with an embodiment.

FIG. 8 is a block diagram illustrating the configuration of a shifting source voltage regulator 113A in accordance with an embodiment. For an embodiment, the shifting source voltage regulator 113A represents the shifting source voltage regulator 113 of FIG. 2. As illustrated in FIG. 8, the shifting source voltage regulator 113A may include an oscillating enable signal generation circuit (OSC_EN GEN) 251, an oscillating circuit (OSC CIR) 253, and a pumping circuit (PUMP CIR) 255.

The oscillating enable signal generation circuit 251 may be coupled to the oscillating circuit 253 and the pumping circuit 255. The oscillating enable signal generation circuit 251 may receive the shifting source voltage SFT_SV from the pumping circuit 255. The oscillating enable signal generation circuit 251 may generate an oscillating enable signal OSC_EN according to a comparison operation between the detection reference voltage VREF_DET and the shifting source voltage SFT_SV. The oscillating enable signal generation circuit 251 may generate the oscillating enable signal OSC_EN that is activated when a voltage level that is generated by dividing the shifting source voltage SFT_SV is lower than the detection reference voltage VREF_DET. The oscillating enable signal generation circuit 251 may generate the oscillating enable signal OSC_EN that is deactivated when the voltage level that is generated by dividing the shifting source voltage SFT_SV is equal to or higher than the detection reference voltage VREF_DET. The oscillating enable signal generation circuit 251 may apply the oscillating enable signal OSC_EN to the oscillating circuit 253.

The oscillating circuit 253 may be coupled to the oscillating enable signal generation circuit 251 and the pumping circuit 255. The oscillating circuit 253 may receive the oscillating enable signal OSC_EN from the oscillating enable signal generation circuit 251. The oscillating circuit 253 may generate a pumping clock PCLK when the oscillating enable signal OSC_EN is activated or when the voltage level that is generated by dividing the shifting source voltage SFT_SV is lower than the detection reference voltage VREF_DET. The oscillating circuit 253 may generate the pumping clock PCLK when the oscillating enable signal OSC_EN is deactivated or when the voltage level that is generated by dividing the shifting source voltage SFT_SV is equal to or higher than the detection reference voltage VREF_DET. The oscillating circuit 253 may apply the pumping clock PCLK, generated when the oscillating enable signal OSC_EN is activated, to the pumping circuit 255.

The pumping circuit 255 may be coupled to the oscillating enable signal generation circuit 251 and the oscillating circuit 253. The pumping circuit 255 may receive the pumping clock PCLK from the oscillating circuit 253. When the pumping clock PCLK is generated or when the voltage level that is generated by dividing the shifting source voltage SFT_SV is lower than the detection reference voltage VREF_DET, the pumping circuit 255 may pump the voltage level of the shifting source voltage SFT_SV. The pumping circuit 255 may apply the shifting source voltage SFT_SV to the oscillating enable signal generation circuit 251.

Figure 9:
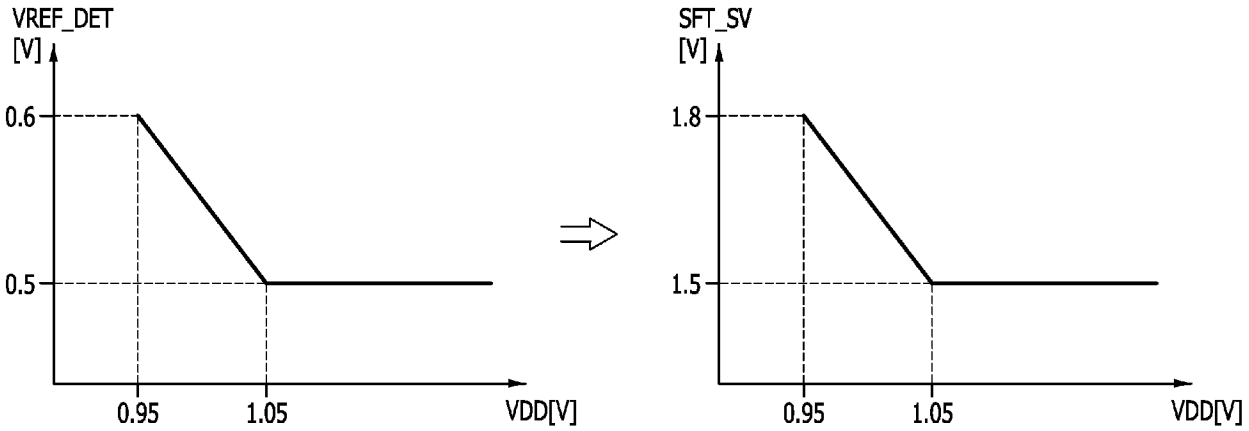
FIG. 9 is a graph for describing an operation of the shifting source voltage regulator in accordance with the embodiment.

FIG. 9 is a graph for describing the operation of the shifting source voltage regulator 113A in accordance with the embodiment. As illustrated in FIG. 9, the shifting source voltage regulator 113A may pump the voltage level of the shifting source voltage SFT_SV based on the detection reference voltage VREF_DET, and the voltage level of the shifting source voltage SFT_SV may be pumped to a voltage level three times higher than the detection reference voltage VREF_DET. More specifically, during a period when the voltage level of the power supply voltage VDD rises from 0.95 V to 1.05 V, the voltage level of the detection reference voltage VREF_DET may fall from 0.6 V to 0.5 V, and the voltage level of the shifting source voltage SFT_SV may fall from 1.8 V to 1.5 V. Furthermore, the detection reference voltage VREF_DET may retain a voltage level of 0.5 V and the shifting source voltage SFT_SV may retain a voltage level of 1.5 V, respectively, during a period when the power supply voltage VDD is equal to or higher than 1.05 V.

Figure 10:
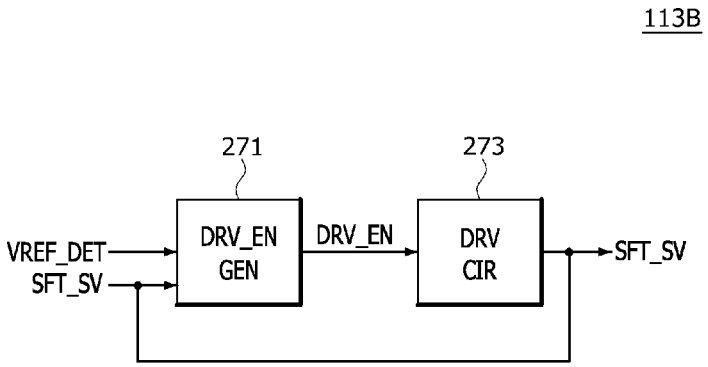
FIG. 10 is a block diagram illustrating the configuration of a shifting source voltage regulator in accordance with another embodiment.

FIG. 10 is a block diagram illustrating the configuration of a shifting source voltage regulator 113B in accordance with another embodiment. For an embodiment, the shifting source voltage regulator 113B represents the shifting source voltage regulator 113 of FIG. 2. As illustrated in FIG. 10, the shifting source voltage regulator 113B may include a driving enable signal generation circuit (DRV_EN GEN) 271 and a driving circuit (DRV CIR) 273.

The driving enable signal generation circuit 271 may generate a driving enable signal DRV_EN according to a comparison operation between the detection reference voltage VREF_DET and the shifting source voltage SFT_SV. The driving enable signal generation circuit 271 may generate the driving enable signal DRV_EN that is activated when a voltage level that is generated by dividing the shifting source voltage SFT_SV is lower than the detection reference voltage VREF_DET. The driving enable signal generation circuit 271 may generate the driving enable signal DRV_EN that is deactivated when the voltage level that is generated by dividing the shifting source voltage SFT_SV is equal to or higher than the detection reference voltage VREF_DET. The driving enable signal generation circuit 271 may apply the driving enable signal DRV_EN to the driving circuit 273.

The driving circuit 273 may drive the shifting source voltage SFT_SV based on the driving enable signal DRV_EN. The driving circuit 273 may drive the shifting source voltage SFT_SV when the driving enable signal DRV_EN is activated or when a voltage level that is generated by dividing the shifting source voltage SFT_SV is lower than the detection reference voltage VREF_DET. The driving circuit 273 may apply the shifting source voltage SFT_SV to the driving enable signal generation circuit 271.

Although some embodiments of the present teachings have been disclosed for illustrative purposes, other embodiments are also possible. For example, those skilled in the art will appreciate that various modifications, additions, and/or substitutions to the presented embodiments are possible, without departing from the scope and spirit of the present teachings as defined in the accompanying claims.

What is claimed is:

1. An internal voltage generation circuit comprising:

a shifting source voltage generation circuit configured to generate a shifting source voltage having a voltage level that falls as a voltage level of a power supply voltage rises during a period when the power supply voltage is lower than a preset voltage level; and an internal voltage regulator configured to generate a driving signal through a level shifting operation that is performed according to the shifting source voltage received when driving an internal voltage and configured to drive the internal voltage based on the driving signal, wherein the shifting source voltage generation circuit comprises:

a detection reference voltage generation circuit configured to generate a detection reference voltage based on the power supply voltage, a first reference voltage, and a second reference voltage; and a shifting source voltage regulator configured to generate the shifting source voltage based on the detection reference voltage and the shifting source voltage.

2. The internal voltage generation circuit of claim 1, wherein the internal voltage regulator comprises an NMOS transistor that is turned on based on the driving signal, the NMOS transistor configured to drive the internal voltage.

3. The internal voltage generation circuit of claim 2, wherein the internal voltage regulator further comprises:

a voltage divider configured to generate a divided voltage by dividing the internal voltage;

an internal voltage comparator configured to generate a pre-driving signal by comparing the divided voltage and an internal reference voltage; and a level shifter configured to generate the driving signal by performing a level shifting operation based on the pre-driving signal and the shifting source voltage.

4. The internal voltage generation circuit of claim 1, wherein the shifting source voltage generation circuit is configured to generate the shifting source voltage having a constant voltage level during a period when the power supply voltage is equal to or higher than the preset voltage level.

5. The internal voltage generation circuit of claim 1, wherein the detection reference voltage generation circuit comprises:

a first detection reference voltage generation circuit configured to generate the detection reference voltage having a voltage level that falls as the voltage level of the power supply voltage rises during a period when the power supply voltage is lower that the preset voltage level; and a second detection reference voltage generation circuit configured to generate the detection reference voltage having a constant voltage level during a period when the power supply voltage is equal to or higher than the preset voltage level.

6. The internal voltage generation circuit of claim 5, wherein the first detection reference voltage generation circuit comprises:

resistors;

a first comparator configured to generate a first comparison signal by comparing a positive input voltage, generated from the power supply voltage based on resistance values of the respective resistors, to the first reference voltage;

a first driving element turned on based on the first comparison signal and configured to drive a node from which the detection reference voltage is output; and a first current source configured to discharge the node.

7. The internal voltage generation circuit of claim 6, wherein the first comparator generates the first comparison signal that is activated during a period when the positive input voltage has a voltage level equal to or lower than the first reference voltage, wherein the first driving element is turned on when the first comparison signal is activated, and wherein the voltage level of the detection reference voltage is set in an inverse proportional relationship to the voltage level of the power supply voltage.

8. The internal voltage generation circuit of claim 6, wherein the second detection reference voltage generation circuit comprises:

a second comparator configured to generate a second comparison signal by comparing the detection reference voltage and the second reference voltage;

a second driving element turned on based on the second comparison signal and configured to drive the node; and a second current source configured to discharge the node.

9. The internal voltage generation circuit of claim 8,
wherein the second comparator generates the second comparison signal that is activated when the detection reference voltage has the same voltage level as the second reference voltage,
wherein the second driving element is turned on when the second comparison signal is activated, and
wherein the voltage level of the detection reference voltage is set to the same voltage level as the second reference voltage.

10. The internal voltage generation circuit of claim 1,
wherein the shifting source voltage regulator is configured to pump the voltage level of the shifting source voltage or drive the shifting source voltage when a voltage level that is generated by dividing the shifting source voltage is lower than the detection reference voltage.

11. The internal voltage generation circuit of claim 10, wherein the shifting source voltage regulator comprises:
an oscillating enable signal generation circuit configured to generate an oscillating enable signal according to a comparison operation between the detection reference voltage and the shifting source voltage;
an oscillating circuit configured to generate a pumping clock based on the oscillating enable signal; and
a pumping circuit configured to pump the voltage level of the shifting source voltage when the pumping clock is generated.

12. The internal voltage generation circuit of claim 10, wherein the shifting source voltage regulator comprises:
a driving enable signal generation circuit configured to generate a driving enable signal according to a comparison operation between the detection reference voltage and the shifting source voltage; and
a driving circuit configured to drive the shifting source voltage based on the driving enable signal.

13. An internal voltage generation circuit comprising:
a first detection reference voltage generation circuit configured to generate a detection reference voltage having a voltage level that falls as a voltage level of a power supply voltage rises during a period when the power supply voltage is lower than a preset voltage level;
a shifting source voltage regulator configured to generate a shifting source voltage based on the detection reference voltage and the shifting source voltage; and
an internal voltage regulator configured to generate a driving signal through a level shifting operation that is performed according to the shifting source voltage received when driving an internal voltage and configured to drive the internal voltage based on the driving signal.

14. The internal voltage generation circuit of claim 13, wherein the first detection reference voltage generation circuit comprises:
resistors;
a first comparator configured to generate a first comparison signal by comparing a positive input voltage, generated from the power supply voltage based on resistance values of the respective resistors, to a first reference voltage;
a first driving element turned on based on the first comparison signal and configured to drive a node from which the detection reference voltage is output; and
a first current source configured to discharge the node.

15. The internal voltage generation circuit of claim 14,
wherein the first comparator generates the first comparison signal that is activated during a period when the positive input voltage has a voltage level equal to or lower than the first reference voltage,
wherein the first driving element is turned on when the first comparison signal is activated, and
wherein the voltage level of the detection reference voltage is set in an inverse proportional relationship to the voltage level of the power supply voltage.

16. The internal voltage generation circuit of claim 13, further comprising a second detection reference voltage generation circuit configured to generate the detection reference voltage having a constant voltage level during a period when the power supply voltage is equal to or higher than the preset voltage level.

17. The internal voltage generation circuit of claim 16, wherein the second detection reference voltage generation circuit comprises:
a second comparator configured to generate a second comparison signal by comparing the detection reference voltage and a second reference voltage;
a second driving element turned on based on the second comparison signal and configured to drive a node from which the detection reference voltage is output; and
a second current source configured to discharge the node.

18. The internal voltage generation circuit of claim 13,
wherein the shifting source voltage regulator is configured to pump the voltage level of the shifting source voltage or drive the shifting source voltage when a voltage level that is generated by dividing the shifting source voltage is lower than the detection reference voltage.

19. The internal voltage generation circuit of claim 13,
wherein the internal voltage regulator comprises an NMOS transistor that is turned on based on the driving signal, the NMOS transistor configured to drive the internal voltage.

* * * * *